US005170826A

United States Patent [19]

Carstensen et al.

[11] Patent Number: 5,170,826

[45] Date of Patent: Dec. 15, 1992

[54] COVER FOR A WHEELCHAIR

[75] Inventors: Marilyn Carstensen, Amherst; Debra S. Gross, North Ridgeville, both of Ohio

[73] Assignee: Invacare Corporation, Elyria, Ohio

[21] Appl. No.: 706,369

[22] Filed: May 28, 1991

[51] Int. Cl.[5] ..... B65D 65/02

[52] U.S. Cl. ..... 150/154; 280/304.1; 280/304.5; 383/86

[58] Field of Search ..... 150/154, 158; 383/86; 280/304.1, 304.5

[56] References Cited

U.S. PATENT DOCUMENTS

| | | | |
|---|---|---|---|
| 1,610,326 | 12/1926 | Schleich et al. | 150/154 |
| 4,244,411 | 1/1981 | Karlstrom et al. | 150/154 |
| 4,679,242 | 7/1987 | Brockhaus | 383/86 |
| 4,693,289 | 9/1987 | Taylor et al. | 280/304.1 |
| 4,948,154 | 8/1990 | Guggenheim | 150/154 |
| 4,954,384 | 9/1990 | Hartwell | 150/154 |
| 5,028,472 | 7/1991 | Gray | 150/158 |

FOREIGN PATENT DOCUMENTS

| | | | |
|---|---|---|---|
| 271800 | 2/1951 | Switzerland | 383/86 |
| 2168018 | 6/1986 | United Kingdom | 280/304.1 |

*Primary Examiner*—Gary E. Elkins

*Attorney, Agent, or Firm*—Fay, Sharpe, Beall, Fagan, Minnich & McKee

[57] ABSTRACT

A cover for a wheeled device is provided. The wheeled device includes a body and at least two wheels that extend from a lower portion of the body in spaced relation to one another for supporting and transporting the body. The cover itself comprises a hood portion adapted for receipt over the body. Specifically, the hood portion comprises an upper end and at least two sides extending from the upper end. The sides define an opening opposite the upper end through which the body is received. A flap member extends from a first side of the hood portion and is adapted for wrapping receipt across a portion of the opening to be matingly received on a surface of the second side of the hood portion.

11 Claims, 6 Drawing Sheets

COVER FOR A WHEELCHAIR

BACKGROUND OF THE INVENTION

This invention is directed to the art of wheelchairs and more particularly to the art of collapsible, portable wheelchairs designed for ease of transportation.

The invention is particularly applicable to a device for covering and carrying or transporting a portable wheelchair in its collapsed position, and will be described with particular reference thereto. It will be appreciated, however, that the invention has broader applications, such as its use in association with carrying and transporting a variety of wheeled devices, and may be advantageously employed in other environments and applications.

Portable, collapsible wheelchairs, such as those described in copending Ser. No. 07/740,434, filed Aug. 5, 1991, incorporated herein by reference, are deemed to be desirable for use by those who seek to transport wheelchairs via airplanes, buses, automobiles, trains, or other forms of transportation. Such collapsible wheelchairs can be folded from their fully opened position to a size and general shape reminiscent of a standard rectangular piece of luggage.

Along these lines, a light-weight device for covering, carrying and transporting the collapsible wheelchair has been developed. The carrying device is not cumbersome, and can be mounted in place on a collapsed wheelchair with ease of operation. Further, it can be removed from the wheelchair with similar ease.

The carrying device is designed to have bottom level openings which permit the wheels from the wheelchair or other wheeled device to extend outside the cover. The wheels themselves can act as rollers which allow the covered device to be rolled and guided along. Alternatively, the covering device is designed so that the collapsed wheelchair can be carried. A handle extends above the cover's uppermost portion to act as a gripping member during transport.

The present invention contemplates a cover and carrying bag for a wheeled device which offers the benefits described above, as well as others.

BRIEF DESCRIPTION OF THE INVENTION

In accordance with the present invention there is provided a cover for a wheeled device which enables a wheeled device, particularly a wheelchair in a collapsed condition, to be transported, guided and carried.

In accordance with a more limited aspect of the invention, a cover for a wheel device includes a body and at least two wheels that extend from a lower portion of the body in spaced relation to one another for supporting and transporting the body. The cover itself comprises a hood portion that is adapted for receipt over the body. The hood portion includes an upper end and at least two sides extending from the upper end. The sides define an opening opposite the upper end through which the body is received. A flap member extends from a first side of the hood portion and is adapted for wrapping receipt across a portion of the opening to be matingly received on an outer surface of the second side of the hood portion.

A principal advantage of the invention is that it provides a light weight cover which enables a collapsible, portable wheelchair or other wheeled device to be transported by carrying or guiding by rolling. The cover keeps the wheelchair clean during its transport or storage and gives the appearance of a piece of luggage. When the carrying device is not in use, it can be folded into a compact position for ease of storage.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof.

DETAILED DESCRIPTION OF THE PREFERRED EMBODIMENT

Figure 1:
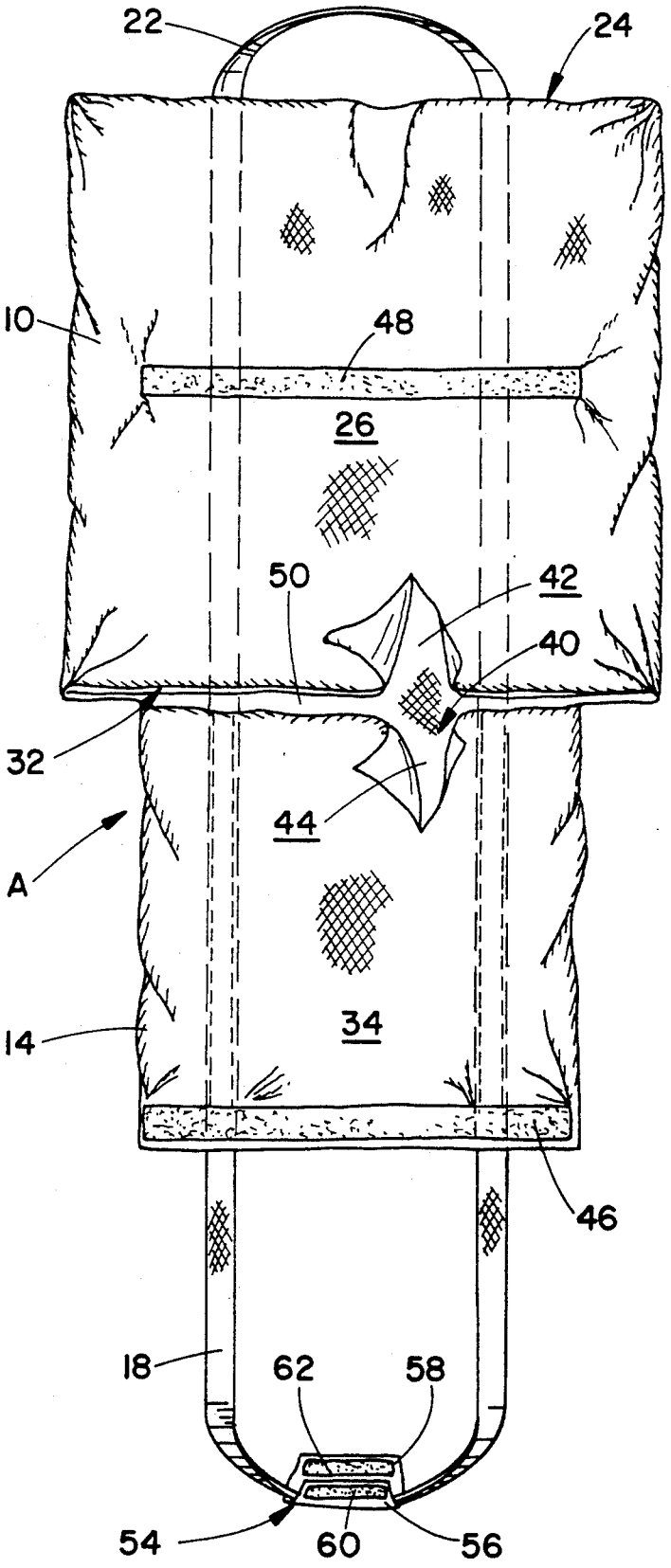
FIG. 1 is a front elevational view of a cover for a wheeled device in accordance with the present invention.
Figure 3:
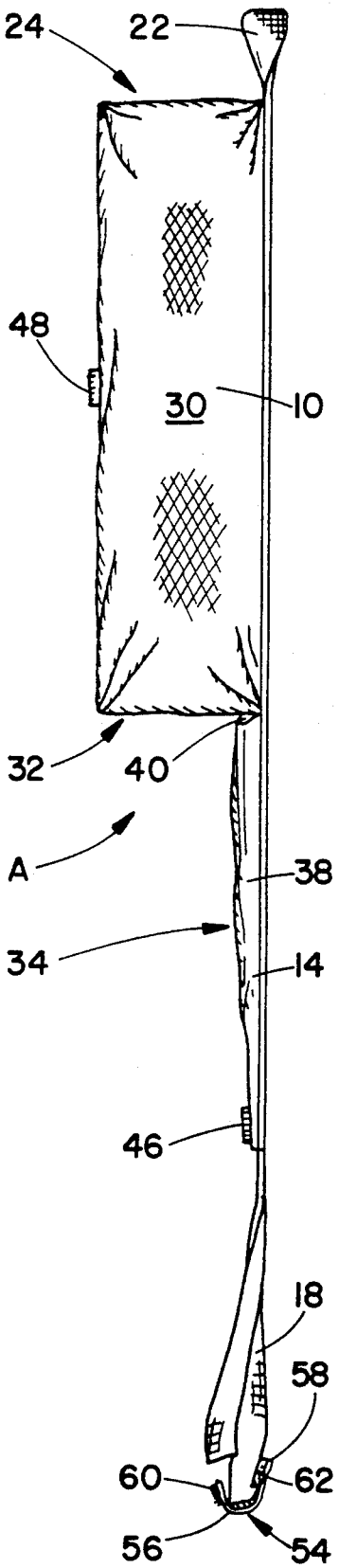
FIG. 3 is a side elevational view of a cover for a wheeled device.
Figure 2:
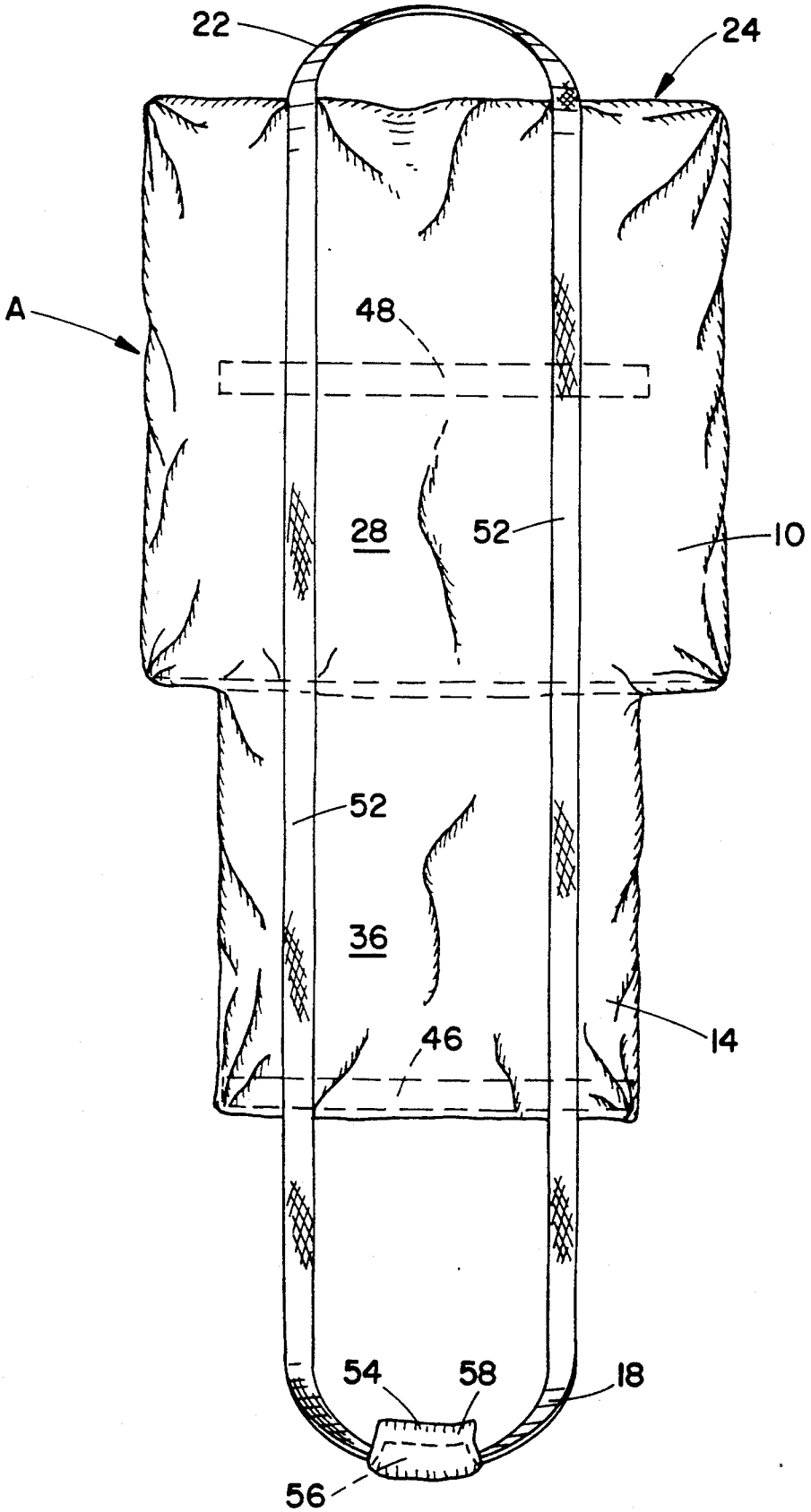
FIG. 2 is a rear elevational view of a cover for a wheeled device in accordance with the present invention.

Referring now to the drawings wherein the showings are for purposes of illustrating the preferred embodiment of the invention only and not for purposes of limiting same, FIGS. 1–3 show front, rear and side elevational views of a cover for a collapsed wheelchair or other wheeled device in accordance with the present invention.

FIGS. 1–3 show a wheelchair cover A in its open or extended position. The wheelchair cover A includes a hooded portion 10 and a flap member 14. A first handle member 18 extends from the flap member 14 and a second handle member 22 extends above a top wall 24 of hood portion 10.

The hood portion 10 comprises a front side or front face 26 and a rear side or front face 28. Left and right sides 30 of the hood 10 are sewn or otherwise adhered to front and rear sides or faces 26, 28. The front, rear and side walls or faces of the hood member 10 together define an opening 32 suited for receipt over a wheeled device. An interior region of the hood is sized to receive the entire body of a collapsed wheelchair.

Flap member 14 extends from rear side 28 of hood portion 10. The flap has a front side 34 and a rear side 36. The rear side 36 is shown to be an extension of the material which comprises the rear side 28 of hood 10, but alternatively can be separately stitched to the hood.

Figure 8:
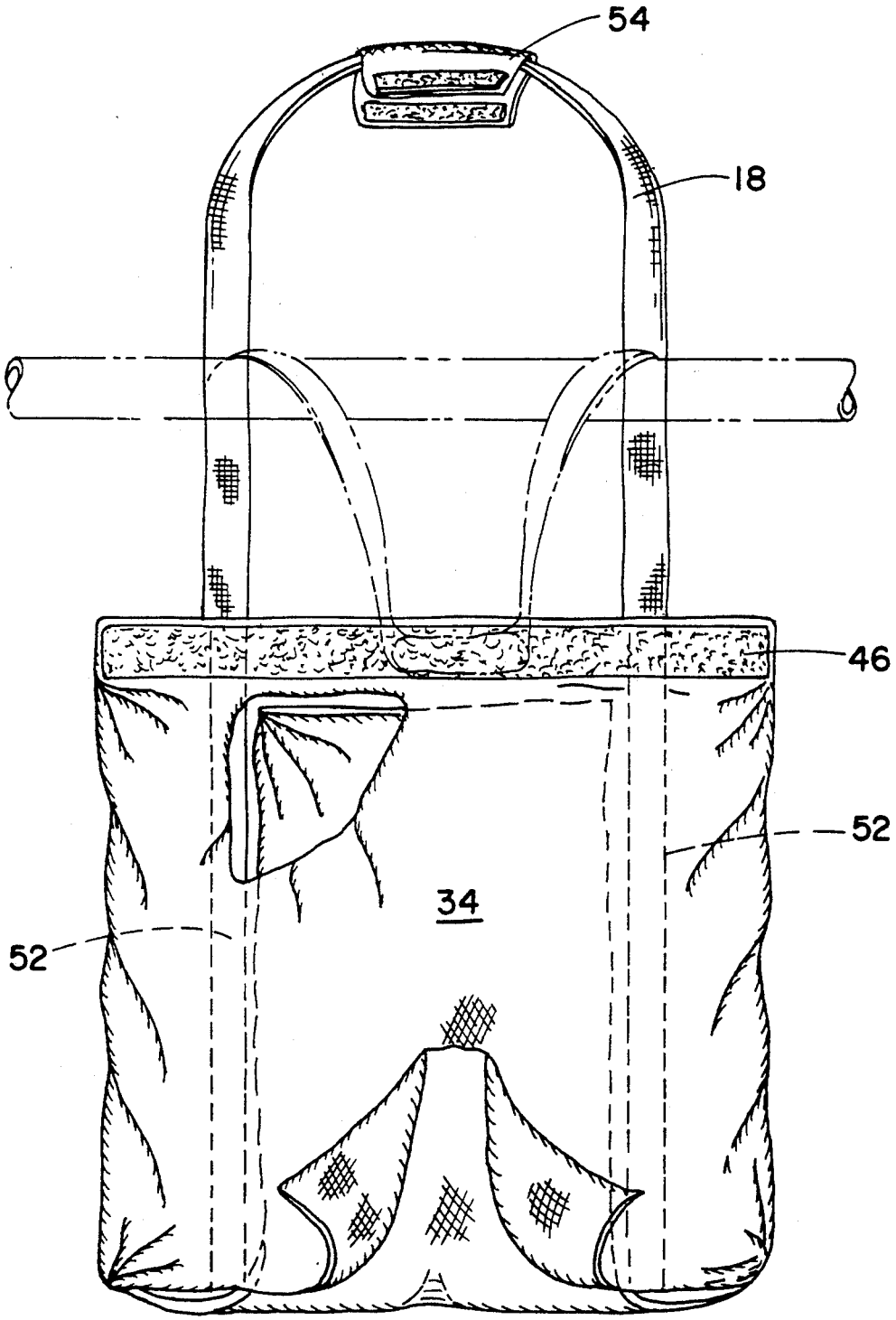
FIG. 8 shows a cover for a wheeled device in accordance with the present invention which has been folded into its non-use or storage position. Portions of the exterior cover material have been torn away.

The extended material roughly defines a block-like T-shape. The flap member 14 has a thickness 38. Front and rear side of flap 14 defines a pocket 40 which is suited for receipt of the hooded portion 10 as set forth in FIG. 8. By folding the hooded portion into the flap pocket 40, the cover member A can be conveniently condensed in size for storage when not in use.

Portions of FIG. 1 have been broken away to show an interior region 42 of hood portion 10 and interior region 44 of pocket 40.

Hook and loop-type fasteners are used for securing the cover into place on a wheelchair. As will be noted in FIG. 1, a segment of hook or loop-type fastener 46 is securely fastened onto the front face of flap 14. A similar segment mating hook or loop-type fastener 48 is likewise fastened or otherwise adhered along a central region of a front face 26 of hood portion 10. In order to secure the cover into place on a wheeled device, front face 34 of flap 14 is folded up along the horizontal region defined by 50 which is between the hood portion and flap portion. The face 34 of flap portion 14 is folded up and received over a substantial portion of a front face 26 of hood member 10. Hook and loop-type fasteners 46 and 48 mate and fasten the flap into place.

While the hook and loop type fasteners are shown in the figures as elongated strips, it is fully within the scope of this invention to have differently shaped or smaller mating segments of such fasteners. It is further within the scope of this invention to use other types of fasteners including, but not limited to, snaps, clamps, zippers, or buttons.

As will be noted, a pair of elongated support or reinforcing strips 52 run in parallel relation to one another across the rear face of the hood portion and the rear face 36 of the flap member 14. The elongated strips 52 extend beyond flap member 14 to merge with first handle member 18. Likewise, strip members 52 extend beyond the upper surface of the rear face 28 of hood portion 10 and merge with second handle member 22 The strips 52 are sewn or otherwise adhered to the parallel elongated strips 52, the first handle member 18 and the second handle member 22 together defining a continuous or unending oblong shape. The fact that the handle members are extensions of strips 52 offers additional support when the wheeled device is carried using the cover. That is, when the cover is mounted on the wheelchair and the flap is in place so that both handles extend above the top of the cover, the parallel strips reach along both the front and rear sides and underneath the wheeled device to provide support or reinforcement for the bag and device when the covered device is carried using the handles 18, 22. It is, however, fully within the scope of the invention to have the handle members affixed directly to the hood and flap portions, or to have them extend from either side of the hood portion adjacent the top surface 24. As stated, the elongated strip members 52 provide added support to the bag and wheelchair member when carried or guided while rolling.

Figure 6:
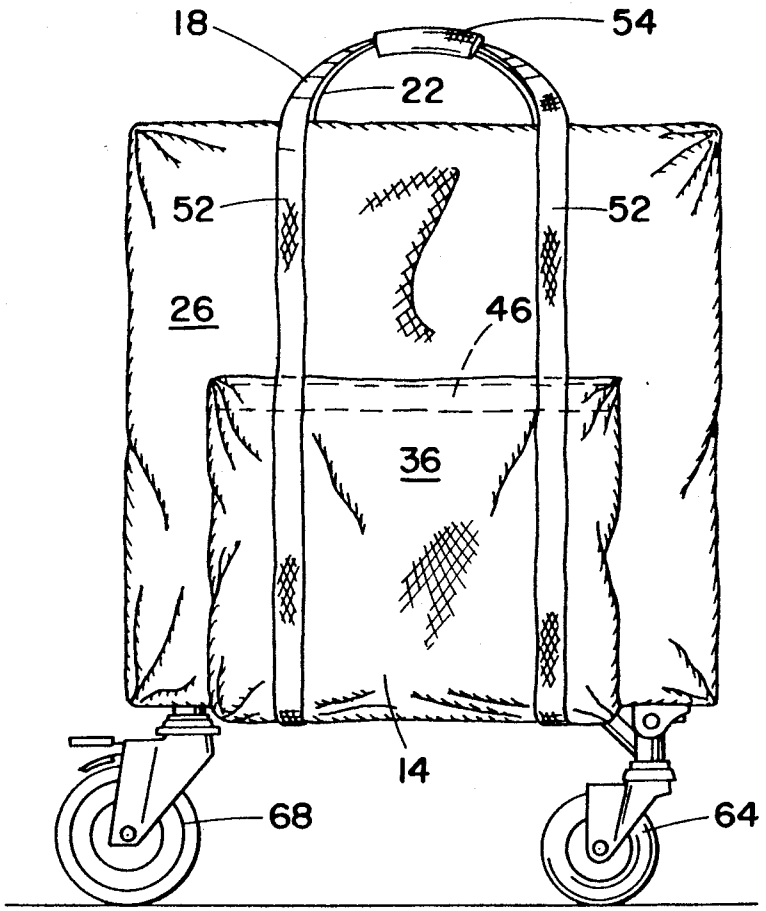
FIG. 6 shows a front elevational view of a wheeled device completely mounted on a wheelchair in its collapsed position.
Figure 7:
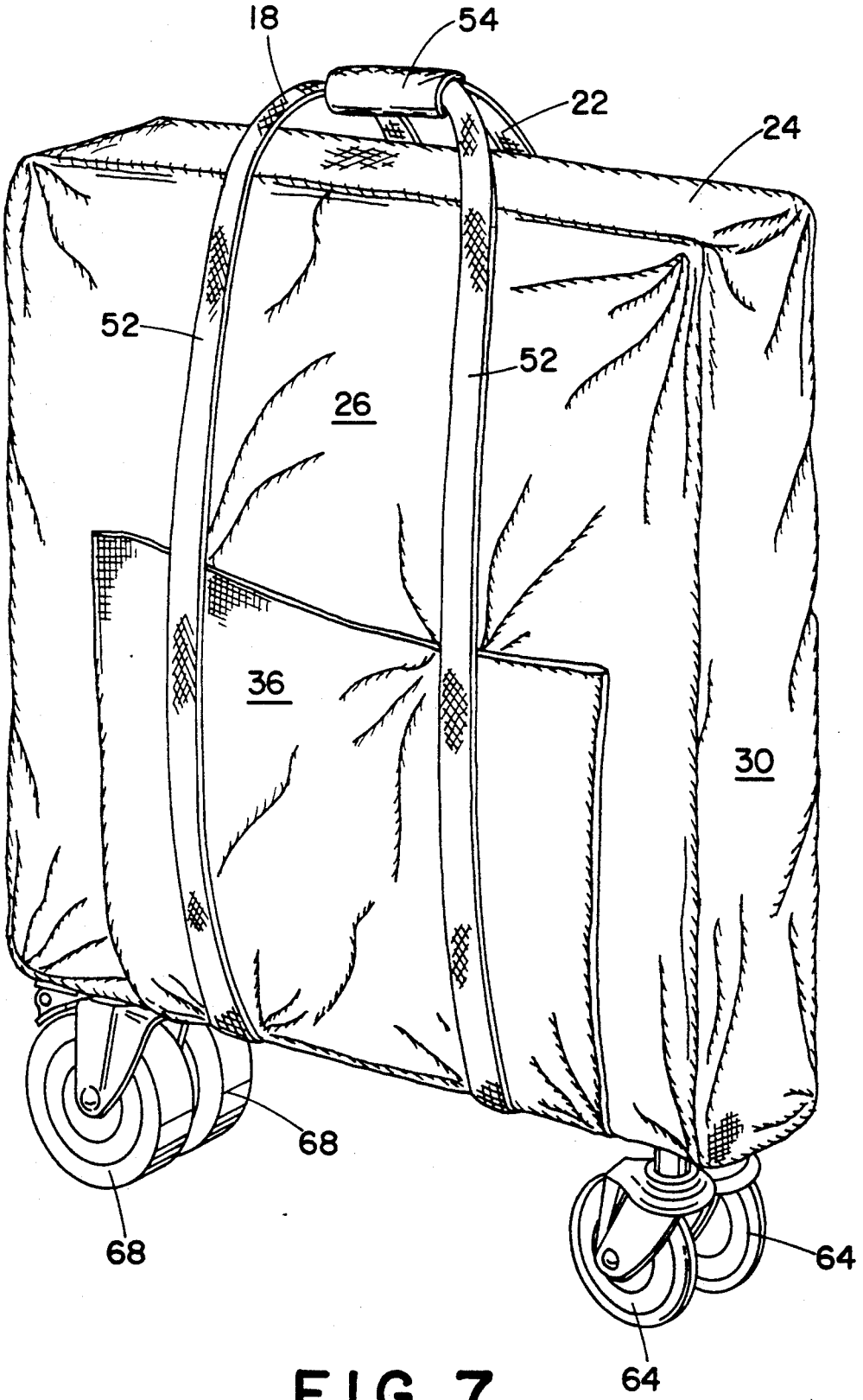
FIG. 7 shows a perspective view of a cover for a wheeled device completely mounted on a collapsed wheelchair.

A gripping member 54 is received around a midportion of first handle member 18. The gripping member includes a first wrapping portion 56 and a second wrapping portion 58. Wrapping portion 56 includes hook or loop-type fasteners 60 on an outer surface thereof. These hook or loop-type fasteners 60 are suited for mating receipt with hook or loop-type fasteners 62 which are positioned on an interior surface of second wrapping portion 58. When the wheelchair cover device A is in closed position as shown in FIGS. 6 and 7, the handle member 22 is wrapped along with handle member 18 in gripping member 56. Hook and loop-type fasteners 60, 62 mate to secure to handle members together. The gripping member provides for ease of handling and comfort when transporting the wheeled device. It is fully within the scope of this invention to use other types of gripping members, such as cushions, or no gripping member at all. Also, the fastener used for mating the first and second wrapping portions can be comprised of snaps or other fastening materials. In the alternative, it is foreseeable that no fasteners are used to close the gripping member about the handle members.

Figure 4:
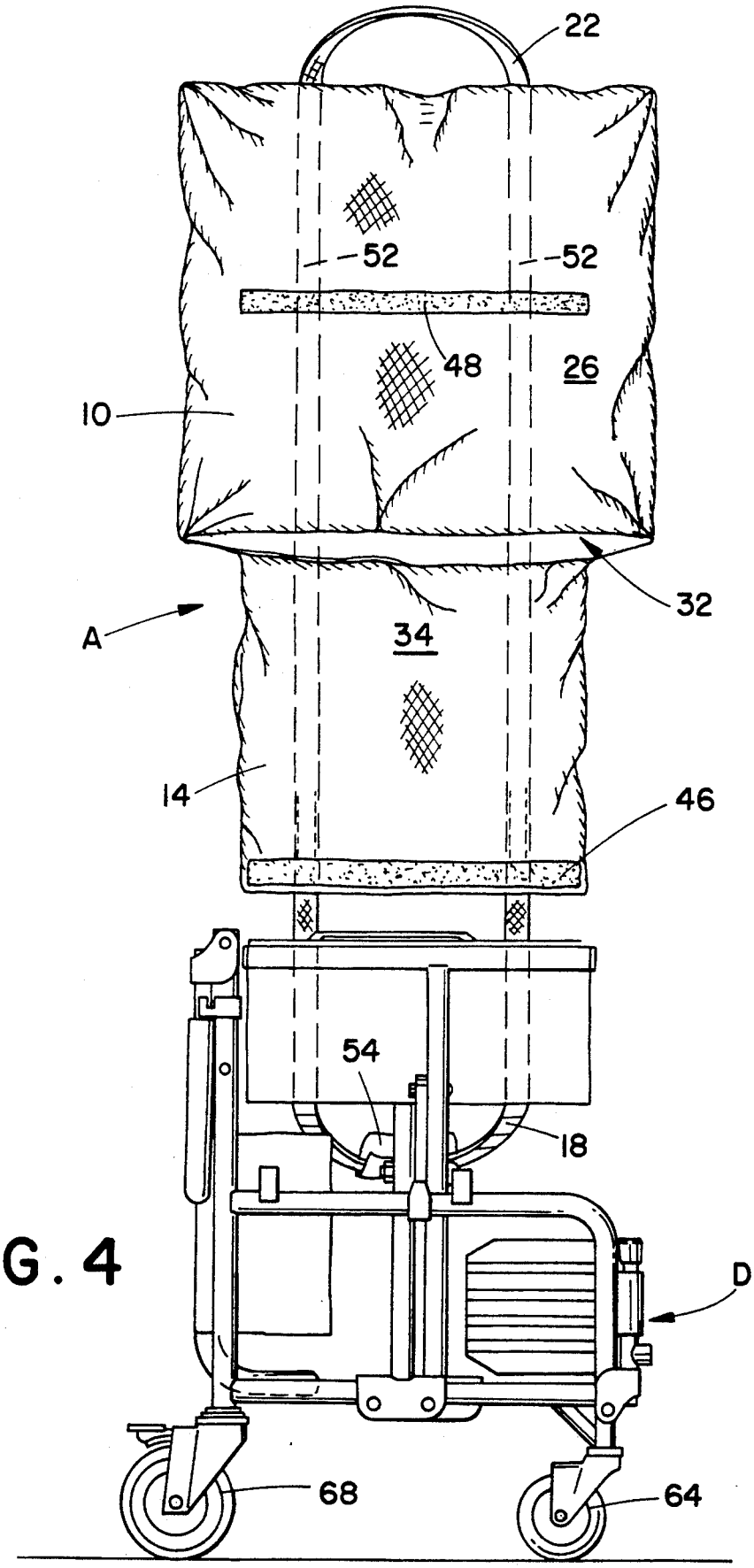
FIG. 4 shows a cover for a wheeled device as it is being mounted on a collapsed wheelchair.
Figure 5:
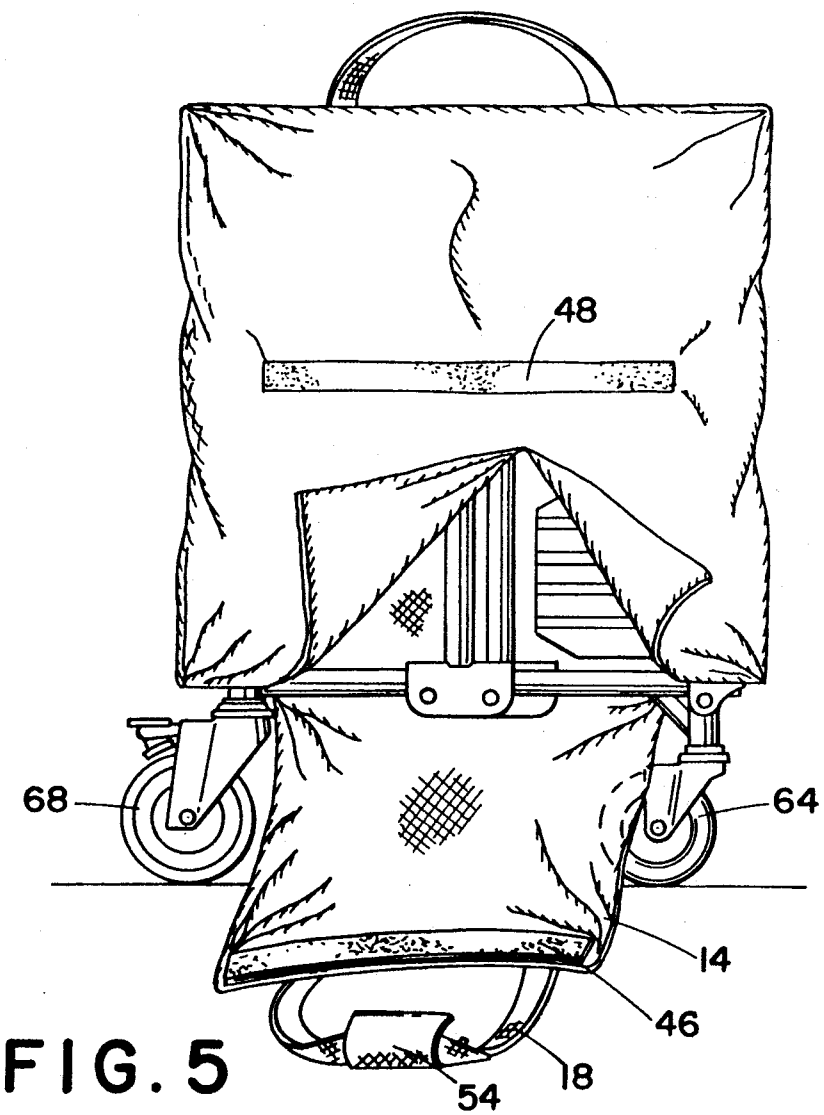
FIG. 5 shows a cover for a wheeled device as it is nearly completely mounted on a wheeled device. A portion of the cover is split apart so that a portion of the wheeled device can be seen.

FIGS. 4 and 5 depict a number of steps involved during placement of wheelchair cover A on a collapsed wheelchair D. Specifically, flap member 14 and handle member 18 are directed behind the wheelchair while the hooded portion 10 is directed over the wheelchair. The wheelchair passes through opening 32 into the interior region defined by the hood.

As FIG. 5 shows, the flap member 14 is extended under the main body from behind wheelchair D between front wheels 64 and back wheels 68. The flap member 14 is then placed in a covering relationship over a portion of hood front face 26 so that the hook or loop-type fastener 46 is matingly received by the hook or loop-type fastener 48. Gripping member 54 wraps around handle members 18 and 22 and is secured by hook and loop-type fasteners 60 and 62.

When the flap member 14 is situated as shown in FIG. 6, most of the opening 32 is covered by the flap member 14. The flap and portions of the front and rear sides of the hood define a pair of wheel holes 70. Wheels 64 and 66 project or extend downwardly through the wheel holes. The wheels project far enough to permit them to roll without the cover fabric interfering.

FIGS. 6 and 7 show the wheelchair cover fully enclosed around a collapsed wheelchair. The wheelchair can be carried by the handle members 22 and 18 which are held together by the gripping member 54, or the entire covered device can be rolled along using the wheeled device's wheels 64 and 66 extending out the holes. The handle members can be used as a guide.

The cover itself is made from resilient yet durable material such as nylon. Preferably, the material is waterproof and sturdy to withstand the weight of the wheelchair as well as various travel conditions.

As discussed above, FIG. 8 shows the wheelchair cover in a folded, compacted position. The hooded portion is folded and inserted into pocket 40 of flap 14. Handle members 18 and 22 extend above this portion and can be hung from the back of the wheelchair while the wheelchair is in use, or they can simply be folded away and stored.

The invention has been described with reference to the preferred embodiment. Obviously, modifications and alterations will occur to others upon a reading and understanding of the specification. It is intended to include all such modifications and alterations insofar as they come within the scope of the appended claims or the equivalents thereof.

Having thus described the invention, we claim:

1. A cover for a wheeled device, the device including a body and at least two wheels extending from a lower portion of the body in spaced relation to one another for supporting and transporting the body, the cover comprising:

a hood portion adapted for receipt over said body, the hood portion comprising an upper end and at least two sides extending from said upper end, the sides defining an opening opposite the upper end through which the body is received; and a flap member extending from said first side of the hood portion, the flap member adapted for wrapping receipt across a portion of the opening so as to be matingly received on an outer surface of said second side of the hood portion, the flap member further adapted to permit the wheels of the wheeled device to extend through the opening.

2. A cover for a wheeled device, including a body and at least two wheels extending from a lower portion of the body in spaced relation to one another for supporting and transporting the body, the cover comprising;

a hood portion adapted for receipt over said body, the hood portion comprising an upper end and at least two sides extending from said upper end, the sides defining an opening opposite the upper end through which the body is received;

a flap member extending from said first side of the hood portion, the flap member adapted for wrapping receipt across a portion of the opening to be matingly received on an outer surface of said second side of the hood portion; and a first handle member extending from the flap member such that when the flap member is secured on the outer surface of the second side of the hood portion the handle extends beyond an upper surface of the hood portion.

3. A cover for a wheeled device, as set forth in claim 2, wherein the width of the flap member is less than the width of the opening defined by the hood.

4. A cover for a wheeled device, as set forth in claim 2, further including a fastening means for securing the flap onto the outer surface of the second side of the hood portion.

5. A cover for a wheeled device, as set forth in claim 2, wherein a second handle member extends from the first side of the hood portion and extends above the upper surface in parallel relation with the first handle member.

6. A cover for a wheeled device, the device including a body and at least two wheels extending from a lower portion of the body in spaced relation to one another for supporting and transporting the body, the cover comprising:

a hood portion adapted for receipt over said body, the hood portion comprising an upper end and at least two sides extending from said upper end, the sides defining an opening opposite the upper end through which the body is received and through which wheels from the body project once the hood is in place over the body; and a flap member extending from said first side of the hood portion, the flap member adapted for wrapping receipt across a portion of the opening and between the wheels to be matingly received on an outer surface of said second side of the hood portion.

7. A cover for a wheeled device, as set forth in claim 6, further including a fastening means for securing the flap onto the outer surface of the second side of the hood portion.

8. A cover for a wheeled device, as set forth in claim 6, further including a first handle member extending from the flap member such that when the flap member is secured on the outer surface of the second side of the hood portion the handle extends beyond an upper surface of the hood portion.

9. A cover for a wheeled device, as set forth in claim 8, wherein a second handle member extends from the first side of the hood portion and extends above an upper surface in parallel relation with the first handle member.

10. A cover for a wheeled device, comprising:

a hood portion including an upper end and at least two sides extending from said upper end, the sides defining an opening opposite the upper end; and a flap member extending from said first side of the hood portion, the flap member adapted from wrapping receipt across a portion of the opening to be matingly received on an outer surface of said second side of the hood portion, wherein the width of the flap member is less than the width of the opening defined by the hood.

11. A cover for a wheeled device, as set forth in claim 10, wherein a first handle member extends from the flap member, and a second handle member extends from the first side of the hood, the first and second handle members situated in parallel relation to each other when the flap member is matingly received on the outer surface of the second side of the hood portion.

* * * * *